United States Patent [19]

Burns

[11] Patent Number: 4,711,812

[45] Date of Patent: Dec. 8, 1987

[54] DELUSTERED NYLON FIBER CONTAINING SEGMENTED STRIATIONS OF POLYPROPYLENE

[75] Inventor: John T. Burns, Seaford, Del.

[73] Assignee: E. I. DuPont de Nemours and Company, Wilmington, Del.

[21] Appl. No.: 800,041

[22] Filed: Nov. 25, 1985

Related U.S. Application Data

[63] Continuation-in-part of Ser. No. 683,242, Dec. 18, 1984, abandoned.

[51] Int. Cl.[4] ..... D02G 3/00

[52] U.S. Cl. ..... 428/401; 428/364; 428/372; 428/373; 428/397

[58] Field of Search ..... 428/364, 372, 373, 401, 428/397; 260/DIG. 23, DIG.32; 525/184

[56] References Cited

U.S. PATENT DOCUMENTS

| | | | |
|---|---|---|---|
| 2,861,319 | 11/1958 | Breen | 28/82 |
| 3,471,426 | 10/1969 | Hofton | 525/184 |
| 3,531,368 | 9/1970 | Okamoto et al. | 428/374 |
| 3,616,184 | 10/1971 | Katagiri et al. | 428/372 X |
| 4,518,744 | 5/1985 | Brody | 525/184 |

*Primary Examiner*—Lorraine T. Kendell

[57] ABSTRACT

Small amounts of selected low molecular weight polypropylene effectively delusters drawn nylon filaments.

4 Claims, 2 Drawing Figures

DELUSTERED NYLON FIBER CONTAINING SEGMENTED STRIATIONS OF POLYPROPYLENE

BACKGROUND OF THE INVENTION

This application is a continuation-in-part of application Ser. No. 683,242, filed Dec. 18, 1984, now abandoned.

BACKGROUND OF THE INVENTION

Various techniques have been tried in the past in an attempt to obtain polyamide filamentary materials with moderate luster. At times modification of the filament cross-section has been useful. Another technique has been to incorporate delustering pigments, e.g. titaninum dioxide ($TiO_2$), in the filament but at the required levels, titanium dioxide often results in chalky character. Polyethylene oxide is known to deluster but it is relatively costly and has oxidation problems associated with it which may adversely affect dye fastness. The present invention achieves significant delustering while substantially avoiding the aforementioned deficiencies.

SUMMARY OF THE INVENTION

This invention provides delustered nylon filaments by melt spinning a blend consisting essentially of nylon and from about 0.1 to 5% by weight of low molecular weight (2000–40,000) polypropylene having a melting point above 120° C. and a viscosity of 200–10,000 centipoise (cp) at 190° C., quenching the filaments and drawing the filaments at a temperature below the softening point of the polypropylene. The delustered nylon filaments contain the polypropylene in generally cylindrical segmented striations with uniform diameter throughout each striation having a length to diameter ratio (L/D) of from 1 to 10 and running generally parallel to the fiber axis.

DETAILED DESCRIPTION OF THE INVENTION

The technique for producing the delustered filaments of the present invention involves first blending the polypropylene into the nylon polymer. This can readily be done by separately melting the nylon polymer of fiber-forming molecular weight and the polypropylene and combining them in the transfer line as the polymer proceeds to the spinneret.

Figure 1:
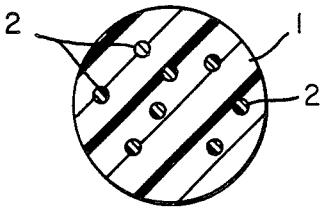
FIG. 1 is a schematic view of a cross-section of the filaments of the invention showing the nylon matrix 1 and the polypropylene 2 dispersed therein.
Figure 2:
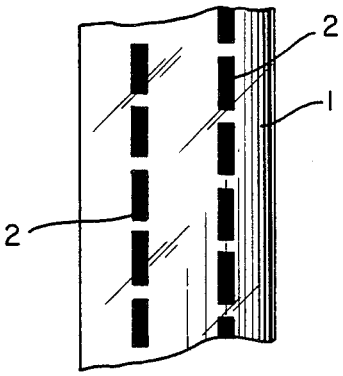
FIG. 2 is a schematic side view through an optical microscope of the filaments of the invention showing the nylon matrix 1 and the polypropylene striations 2.

The nylon polymer may be, for example, polycaproamide (nylon 6), or polyhexamethylene adipamide (nylon 6,6). The delustering effect has been particularly noted with nylon 6,6. Selection of the appropriate polypropylene is very important. The melting point should be above 120° C. preferably, about 160° C. The molecular weight of the polypropylene should be in the range of 2000 to 40,000, most preferably about 4500 and should have a melt viscosity in the range of 200–10,000 cp at 190° C. The character of the polypropylene component is believed responsible for the formation within the nylon filaments, of segmented polypropylene striations which are generally cylindrical and have a length to diameter ratio (L/D) of from about 1 to 10. In practice a photograph is taken of the view under an optical microscope and the L/D measured on the photograph. The presence of the polypropylene segments shown in FIGS. 1 and 2 is believed to be responsible for the delustering effect. The use of high molecular weight polypropylene drawable at room temperature would not provide such segments but would, in fact, result in the polypropylene being drawn along with the nylon matrix material. The cylindrical form of the segments is established and the L/D ratios are determined with optical microscope on whole, and electron microscope on fibers cut in cross-section and along the length.

About 0.1 to 5% by weight of the specified polypropylene is injected into the nylon stream. Preferably about 0.20–3.0% is used. Amounts below about 0.1% provide little benefit while exceeding 5% often results in loss of filament tenacity. The melt-spun filaments are then quenched and drawn using conventional techniques. Draw ratios of 2.0 to 4.0 are usual at temperatures of 50° C. to 120° C. It is important that the temperature of the fiber during drawing not exceed the softening point of the polypropylene if segmented polypropylene striations are to form. In fact, the presence of long unbroken striations would indicate a failure to properly practice the invention.

The delustered filaments may have a denier of 1 to 25 and may be of any cross-section. Trilobal filaments with low modification ratios are particularly benefited by this invention in that they produce lower bulk and brighter luster than high modification ratios. The use of titanium dioxide at levels up to 0.35% by weight in combination with the polypropylene permits use of lesser amounts of polypropylene to create a delustering effect. At these levels, the chalkiness effect of $TiO_2$ is subdued.

TEST PROCEDURES

Viscosity of the polypropylene (except as otherwise stated) is reported as 1.15 times the viscosity in centipoise (cp) as measured with a Brookfield Thermosel following ASTM-D-3236 at 190° C.

Softening point is reported in °C. as determined by differential scanning calorimetry.

Molecular weight of polypropylene and polyethylene is reported as Number Average Molecular Weight and is measured by gel permeation chromatography using NBS-1475 linear polyethylene as the reference standard and orthodichlorobenzene as the solvent.

Melting point in °C. was measured by differential scanning calorimetry (DSC).

The examples that follow are illustrative of the present invention and certain controls. The delustering effect of the present invention is evaluated by a panel.

EXAMPLE 1

Polyhexamethylene adipamide of 60 relative viscosity was melted in a screw extruder, then fed through a transfer line to a meter pump, filter pack and spinneret in a conventional manner. During passage of the polyhexamethylene adipamide through the transfer line, a pelletized polypropylene (molecular weight 4500) was melted (melt point of 158° C. viscosity of 575 cp and softening point 146° C.) and injected into the molten polyhexamethylene adipamide the transfer line which contains static mixer elements (Kenics mixers) at a level of 2 parts of the melted additive per 98 parts polyhexamethylene adipamide. Yarn was spun as 332 trilobal filaments with a modification ratio of 1.65 cold drawn to 18 dpf and cut to 7.5 inch staple. After the drawing process, the fibers were observed to have been dramatically delustered. Staple filaments were observed under an optical microscope and found to have a pattern of broken polypropylene striations, varying in L/D ratio of from >1 to <10. A carpet was made from the staple fiber. It was comparable to a carpet containing 0.4% $TiO_2$ in the amount of delustering, but without the chalkiness observed with $TiO_2$. The carpet was observed to have a natural wool-like appearance as compared to the synthetic look of $TiO_2$ delustered staple.

EXAMPLE 2

Polyhexamethylene adipamide of 60 relative viscosity and containing 0.15% $TiO_2$ was melted in a screw extruder, then fed through a transfer line to a meter pump, filter pack and spinneret in a conventional manner. During passage of the polyhexamethylene adipamide through the transfer line, a pelletized polypropylene (molecular weight 4500) was melted (melt point of 158° C., viscosity of 575 cp and softening point ~146° C.) and injected into the molten polyhexamethylene adipamide at a level of 0.35 parts of the melted additive per 99.65 parts polyhexamethylene adipamide. Yarn was spun as 332 trilobal filaments with a modification ratio of 1.65/2.3 (50%/50%), cold drawn to 18 dpf and cut to 7.5 inch staple. After the drawing process, the fibers were observed to have been delustered. Staple filaments were observed under an optical microscope and found to have a pattern of broken polypropylene striations, varying in L/D ratio of from >1 to <10.

EXAMPLE 3

(Control)

Polyhexamethylene adipamide of 60 relative viscosity and containing 0.15% $TiO_2$ plus antioxidants was melted in a screw extruder, then fed through a transfer line to a meter pump, filter pack and spinneret in a conventional manner. During passage of the polyhexamethylene adipamide through the transfer line, a flaked charge of polyethylene oxide (PEO) having a molecular weight of 20,000 (hydroxyl number) was melted (60° C. melt point, Brookfield viscosity of 6000 cps at 145° C.) and injected into the molten polyhexamethylene adipamide at a level of 0.5 parts of the melted additive per 99.5 parts polyhexamethylene adipamide. Yarn was spun as 332 trilobal filaments with a modification ratio of 1.65/2.3 (50%/50%), cold drawn to 18 dpf and cut to 7.5 inch staple. After the drawing process, the fibers were observed to have been delustered. Staple filaments were observed under an optical microscope and found to have long striations of PEO plus a dispersion of $TiO_2$ particles. When a carpet was made of equal construction and dyed to the same shade as that made in Example 2, the carpets were found to be interchangeable.

EXAMPLE 4

(Control)

Polyhexamethylene adipamide of 60 relative viscosity was melted with polypropylene (molecular weight of 60,000) at a ratio of 93 to 7 respectively in a screw extruder, then fed through a transfer line to a meter pump, filter pack and spinneret in a conventional manner. Yarn was spun as 136 trilobal filaments with a modification ratio of 2.45 and drawn at a temperature below the softening point of polypropylene to 22 dpf. After the drawing process, the fibers were observed to have a bright luster attributed to the long unbroken striations of the polypropylene.

EXAMPLE 5

(Control)

Polyhexamethylene adipamide of 60 relative viscosity was melted in a screw extruder, then fed through a transfer line to a meter pump, filter pack and spinneret in a conventional manner. During passage of the polyhexamethylene adipamide through the transfer line, a pelletized polyethylene (molecular weight 2200) was melted (melt point of 108° C., Brookfield viscosity of 350 cp at 125° C.) and injected into the molten polyhexamethylene adipamide at a level of 3.6 parts of the melted additive per 96.4 parts polyhexamethylene adipamide. Yarn was spun as 332 trilobal filaments with a modification ratio of 1.65 cold drawn to 18 dpf and cut to 7.5 inch staple. After the drawing process, the fibers were observed to have been delustered to a mild degree. Staple filaments under an optical microscope were found to have few broken polyethylene striations.

I claim:

1. Delustered nylon filaments containing from about 0.1 to 5% by weight of polypropylene having a melting point above 120° C., molecular weight of 2,000–40,000, and viscosity of 200–10,000 cp at 190° C., said polypropylene being present in generally cylindrical segmented striations, each striation having a uniform diameter throughout its length, an L/D ratio of from 1 to 10 and running generally parallel to the fiber axis.

2. The filaments of claim 1 wherein the nylon is polyhexamethylene adipamide.

3. The filaments of claim 2 wherein the polypropylene has a melting point of about 160° C.

4. The filaments of claim 3 wherein the polypropylene has a molecular weight of 2,000–12,000 and a viscosity of 200–2,000 at 190° C.

* * * * *